US010931031B2

(12) United States Patent
Astakhov et al.

(10) Patent No.: US 10,931,031 B2
(45) Date of Patent: Feb. 23, 2021

(54) COMPACT ANTENNA HAVING THREE-DIMENSIONAL MULTI-SEGMENT STRUCTURE

(71) Applicant: Topcon Positioning Systems, Inc., Livermore, CA (US)

(72) Inventors: Andrey Vitalievich Astakhov, Moscow (RU); Dmitry Vitalievich Tatarnikov, Moscow (RU); Pavel Petrovich Shamatulsky, Moscow (RU); Anton Pavlovich Stepanenko, Moscow (RU)

(73) Assignee: Topcon Positioning Systems, Inc., Livermore, CA (US)

( * ) Notice: Subject to any disclaimer, the term of this patent is extended or adjusted under 35 U.S.C. 154(b) by 0 days.

(21) Appl. No.: 16/607,147

(22) PCT Filed: Nov. 16, 2018

(86) PCT No.: PCT/RU2018/000754

§ 371 (c)(1),
(2) Date: Oct. 22, 2019

(87) PCT Pub. No.: WO2020/101525

PCT Pub. Date: May 22, 2020

(65) Prior Publication Data

US 2021/0013625 A1 Jan. 14, 2021

(51) Int. Cl.
*H01Q 1/38* (2006.01)
*H01Q 21/06* (2006.01)
(Continued)

(52) U.S. Cl.
CPC ..... *H01Q 21/065* (2013.01); *H01Q 1/48* (2013.01); *H01Q 15/24* (2013.01)

(58) Field of Classification Search
CPC ..... H01Q 21/065; H01Q 15/24; H01Q 1/48
See application file for complete search history.

(56) References Cited

U.S. PATENT DOCUMENTS 8,842,045 B2 9/2014 Tatarnikov et al.
2013/0027253 A1* 1/2013 Lin ..... H01Q 5/28 343/700 MS (Continued)

FOREIGN PATENT DOCUMENTS

CN 106711596 A 5/2017
CN 206401512 U 8/2017

(Continued)

OTHER PUBLICATIONS

D. Bianchi et al., "Fast Optimization of Ultra-Broadband Antennas With Distributed Matching Networks," IEEE Antennas and Wireless Propagation Letters, vol. 13, 2014, pp. 642-645.

(Continued)

*Primary Examiner* — Dieu Hien T Duong
(74) *Attorney, Agent, or Firm* — Chiesa Shahinian & Giantomasi PC

(57) ABSTRACT

A GNSS compact antenna comprising a conducting ground plane and a driven element for exciting right hand circularly polarized waves having a multi-segment structure such that the area around the driven element is divided into elementary cells with conductors and circuit elements arranged therein. The antenna includes a set of circuit elements connecting the neighboring elementary cells and the driven element. Each elementary cell has a horizontal conductor over the ground plane, and each elementary cell can have a vertical conductor and a circuit element connecting the horizontal and vertical conductors. The horizontal conductor comprises a set of characteristic points to which circuit elements, connecting neighboring elementary cells or any elementary cell and the driven element, are connected. Both the impedance of each circuit elements and the design of each elementary cell can be different, but the antenna has four-fold rotational symmetry relative to the vertical axis.

20 Claims, 11 Drawing Sheets

(51) Int. Cl.
*H01Q 15/24* (2006.01)
*H01Q 1/48* (2006.01)

(56) References Cited

U.S. PATENT DOCUMENTS

| | | | | |
|---|---|---|---|---|
| 2016/0043479 | A1 | 2/2016 | Tatarnikov et al. | |
| 2016/0211581 | A1 | 7/2016 | Sampo et al. | |
| 2017/0194703 | A1* | 7/2017 | Watson | H01Q 1/523 |
| 2018/0090851 | A1* | 3/2018 | Feldman | H01Q 21/065 |
| 2018/0366818 | A1* | 12/2018 | Kawaguchi | H01Q 21/065 |
| 2019/0302225 | A1* | 10/2019 | Kawaguchi | H01Q 15/14 |

FOREIGN PATENT DOCUMENTS

| | | | |
|---|---|---|---|
| CN | 107634319 | A | 1/2018 |
| EP | 1905126 | B1 | 10/2009 |
| JP | 2015019132 | A | 1/2015 |
| RU | 2471272 | C1 | 12/2012 |
| RU | 2619846 | C2 | 5/2017 |

OTHER PUBLICATIONS

International Search Report and Written Opinion dated Aug. 22, 2019, in connection with International Patent Application No. PCT/RU2018/000754, 7 pgs.

* cited by examiner

COMPACT ANTENNA HAVING THREE-DIMENSIONAL MULTI-SEGMENT STRUCTURE

CROSS-REFERENCE TO RELATED APPLICATIONS

This application is a National Stage under 35 U.S.C. 371 of PCT/RU2018/000754, filed Nov. 16, 2018, the entire content of which is incorporated herein by reference.

TECHNICAL FIELD

The present invention relates generally to Global Navigation Satellite System (GNSS) antenna design and, more particularly to micropatch antennas for global navigation satellite systems.

BACKGROUND

Micropatch antennas are well suited for navigation receivers in global navigation satellite systems. These antennas have the desirable features of compact size and wide bandwidth. Wide bandwidth is of particular importance for navigation receivers that receive and process signals from more than one GNSS. Currently deployed GNSSs are the US Global Positioning System (GPS), the Russian GLONASS system, the Chinese BeiDou system and the European Galileo system. Other Global and regional Satellite Navigation Systems such as Japan QZSS and Indian IRNSS systems are planned. Multi-system navigation receivers provide higher reliability due to system redundancy and better coverage due to a line-of sight to more satellites.

There is a current focus in the industry directed to miniaturization in designing antenna systems delivering broadband operations with a directional pattern (DP) of a defined shape being ensured. For GNSS applications, it is typically required to provide operation in a bandwidth ranging from 1165 MHz to 1300 MHz and 1530 MHz to 1610 MHz. In addition, there is a desire that DP in the backward hemisphere be as low as possible to suppress signals reflected from the underlying ground surface. As such, the DP back-lobe needs to have a low level, i.e., providing a high front-to-back ratio.

Compact antennas often include resonant antennas with one or more defined resonances where the resonant elements have a simple geometry. For example, patch antennas are widely used given such antennas have a low height but operate in comparatively narrow frequency band. Also, stacked patch antennas are utilized for operations involving several frequency bands. To provide a low level of the back-lobe and a small lateral dimension, an additional parasitic stacked patch antenna can be designed. For example, U.S. Pat. No. 8,842,045 describes one such antenna system having a top antenna assembly and bottom antenna assembly. The bottom antenna assembly is adjusted such that the fields of the top and bottom antenna assemblies are subtracted in the lower hemisphere. Although such an antenna system has a small lateral size, the presence of the two antenna assemblies result in overall height increases, and increased production costs in view of the complicated overall antenna design.

Numerical optimization methods allow for designing antennas with complicated structures that are more streamlined but carry a considerable computational load in view of the optimization methodologies. To address the excessive computation requirement, it is desirable to use a structure as a set of elementary cells with simple geometric shapes. For example, one broadband low-profile structure without explicit resonances is described in European Patent EP1905126 B1. In this broadband design, the currents have many different flowing ways. However, such an antenna has a larger-sized lateral diameter (i.e., 140 mm), and the operational design includes an absorber thereby causing a reduction in antenna efficiency. Further, conducting strips of such an antenna structure are complicated in their geometric shape thereby making numerical optimization more difficult than designs with more streamlined geometries.

In another antenna design, Chinese Patent No. 107634319 describes an antenna with a patch in the central area with the patch being excited by a coaxial pin. Around the coaxial pin is a set of metamaterial structure units with each metamaterial structure unit comprising an upper metal patch, a metalized shorting pin, a metal grounding plate and a dielectric substrate. This antenna structure employs simpler shaped elements which contributes to a lower numerical optimization overhead and makes it possible to obtain fewer resonances. However, it appears that these resonances are quite narrow-banded, and the structure has a more limited parameter variability thereby restricting numerical optimization capabilities.

Therefore, a need exists for an improved GNSS compact antenna system having a low back-lobe level, higher degree of parameter adjustability and less complex geometric shapes to increase numerical optimization efficiency.

BRIEF SUMMARY OF THE EMBODIMENTS

In accordance with various embodiments, an improved GNSS compact antenna is provided comprising a conducting ground plane and a driven element for exciting right hand circularly polarized waves.

In accordance with an embodiment, the antenna has a multi-segment structure such that the area around the driven element is divided into elementary cells with conductors and circuit elements arranged therein. The antenna also includes a set of circuit elements connecting the neighboring elementary cells and the driven element. Each elementary cell has a first conductor located above and parallel with the ground plane (i.e., a horizontal conductor over the ground plane). In addition, each elementary cell can have a second conductor connected and orthogonal to the ground plane (i.e., a vertical conductor) and a circuit element connecting the horizontal and vertical conductors. The horizontal conductor comprises a plurality of characteristic points to which circuit elements, connecting neighboring elementary cells or any elementary cell and the driven element, are connected. Both the impedance of each circuit elements and the design of each elementary cell can be different, but the antenna has 4-fold rotational symmetry (i.e., 90° rotational symmetry) relative to the vertical axis. Impedance of the circuit elements can be selected by any number of numerical optimization methods.

In an embodiment, the antenna includes a vertical wall at an external perimeter of the antenna (i.e., a conducting vertical coupling element located along a peripheral region of the antenna and having a first edge and a second edge). A portion of the elementary cells are connected to a top edge of the vertical wall via the circuit elements, and the bottom edge of the vertical wall forms a galvanic couple with the ground plane. In a further embodiment, a slot is formed between the bottom edge of the vertical wall and the ground plane in which circuit elements are connected. The arrangement and nominal values of impedance of these circuit elements can differ, but the four-fold rotational symmetry of the antenna is maintained. The vertical wall also maintains the 4-fold rotational symmetry and can take any number of different geometries (e.g., a square, circular or any other geometry).

These and other advantages of the embodiments will be apparent to those of ordinary skill in the art by reference to the following detailed description and the accompanying drawings.

DETAILED DESCRIPTION

In accordance with various embodiments, an improved GNSS compact antenna is provided comprising a conducting ground plane and a driven element for exciting right hand circularly polarized waves.

Figure 1A:
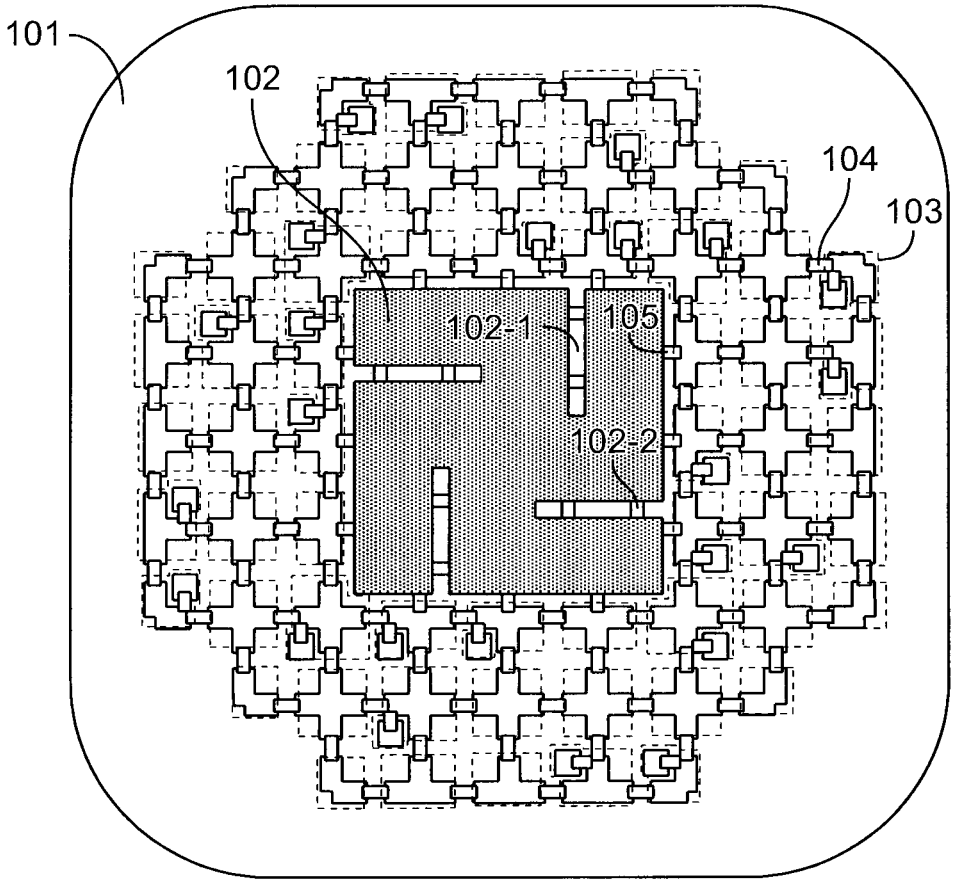
FIGS. 1A and 1B show an antenna configured in accordance with an embodiment.
Figure 1B:
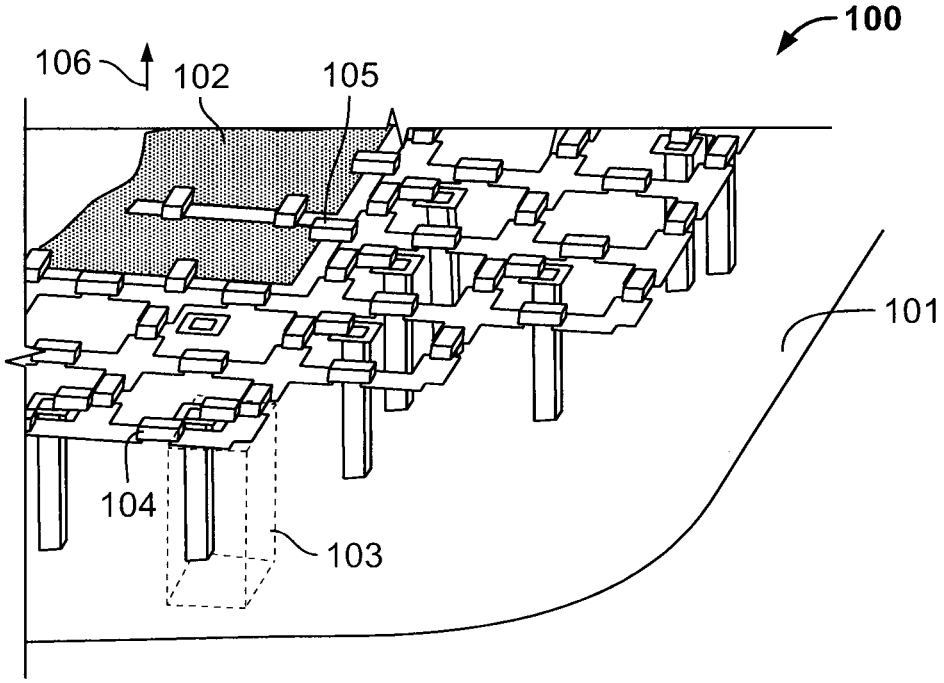

FIGS. 1A and 1B show an antenna configured in accordance with an embodiment. Antenna 100 comprises conducting ground plane 101, driven element 102, a plurality of elementary cells 103 arranged around driven element 102, a first plurality of circuit elements 104 connecting neighboring elementary cells 103 and a second plurality of circuit elements 105 connecting the plurality of elementary cells 103 and driven element 102. Each one of elementary cells 103 has a certain volume and, as shown in FIG. 1B, the conditional limits of each one of elementary cells 103 are marked by dotted lines.

As will be readily appreciated, driven element 102 generates right hand circularly polarized waves in a well-known fashion. Driven element 102 is not resonant, cannot operate as a separate antenna and may be constructed using a metal plate and a dividing circuit. Driven element 102 is excited by a plurality of slots or pins in a well-known fashion. Driven element 102, illustratively, has four (4) slots 102-1, and the dividing circuit (not shown) providing equally-amplitude excitation of electromagnetic field in slots with a phase shift of ninety degrees (90°) such that right hand circularly polarized wave is excited in the direction of axis 106. In slots 102-1 there is a third plurality of circuit elements 102-2 ensuring antenna's match. Each output of the dividing circuit is connected to a wire which crosses a corresponding slot 102-1 and thus excites an electromagnetic field in the slot. In an embodiment, excitation can be implemented using a well-known method used in the patch antenna design, namely by excitation pins arranged vertically between ground plane 101 and a plate of the driven element 102.

FIGS. 2A-2G show various alternative configurations of elementary cells 103 shown in FIGS. 1A and 1B. Common to all of these embodiments is that each elementary cell 103 comprises a horizontal conductor 201 located over conducting ground plane 101 (i.e., a horizontal conductor over the ground plane), a vertical conductor 202 (i.e., a second conductor connected and orthogonal to the ground plane) and circuit element 203. Vertical conductor 202 is connected to ground plane 101. A first end of circuit element 203 is connected to horizontal conductor 201, and the other second end of circuit element 203 is connected to the top end of vertical conductor 202. In order to facilitate the foregoing connections, the top end of the vertical conductor incorporates contact pad 204. At the first and second ends (i.e., opposing ends) of horizontal conductor 201 there are contact pads 205, which can be connected to circuit elements 104 and 105. The number of contact pads in elementary cell 103 can vary as shown in the various configurations set forth in FIGS. 2A-2G.

Figure 2A:
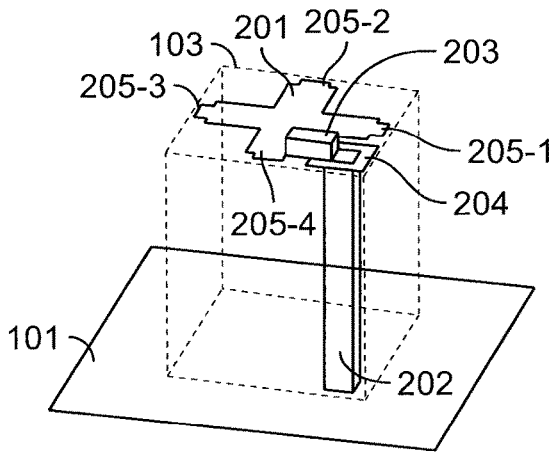
FIGS. 2A-2G show various alternative configurations of the elementary cells shown in FIGS. 1A and 1B.
Figure 2B:
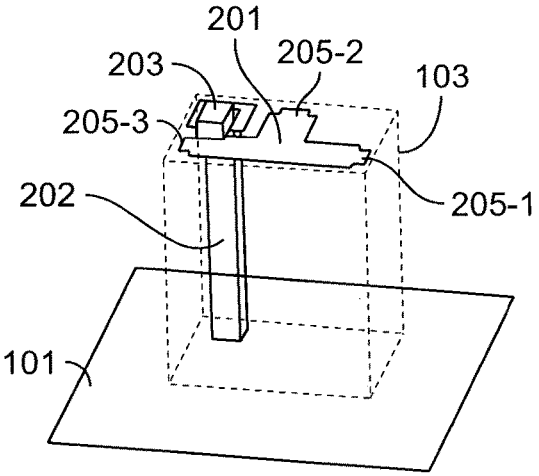
Figure 2C:
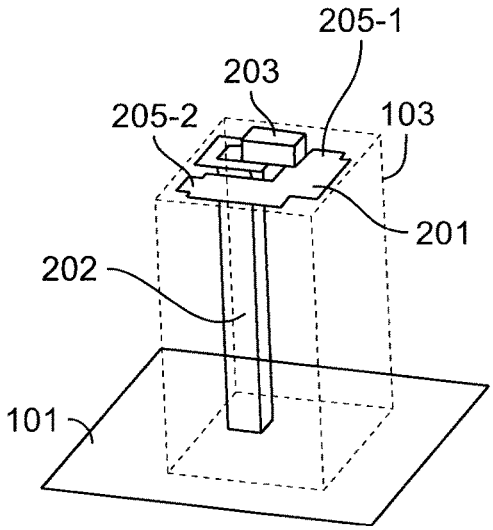
Figure 2D:
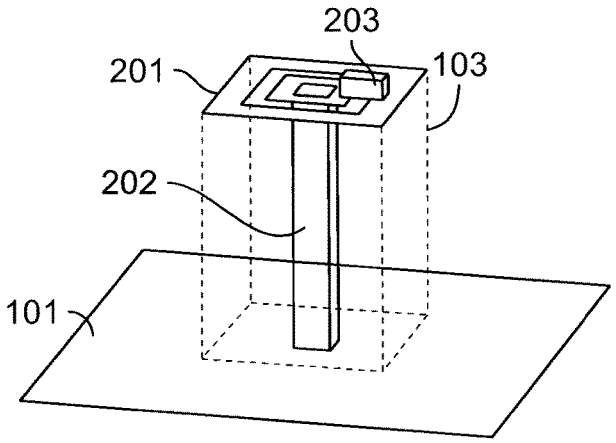

In the embodiment of FIG. 2A, horizontal conductor 201 is cross-shaped with the each respective end of the cross-shape having a respective contact pad (i.e., contact pad 205-1, contact pad 205-2, contact pad 205-3 and contact pad 205-4). Correspondingly, four circuit elements 104 and/or 105 (see, FIG. 1B) can be connected to individual elementary cell 103. In the embodiment of FIG. 2B, horizontal conductor 201 is T-shaped, with the ends comprising three (3) contact pads (i.e., pad 205-1, pad 205-2, pad 205-3). In the embodiment of FIG. 2C, horizontal conductor 201 is L-shaped with two contact pads 205-1 and 205-2, respectively. In the configuration of FIG. 2D, horizontal conductor 201 is square ringed with vertical conductor 202 in the center. The sides of horizontal conductor 201 comprise four (4) contact pads (not shown) to connect circuit elements 104 and 105 in a similar fashion as previously described with respect to FIG. 2A.

Figure 2E:
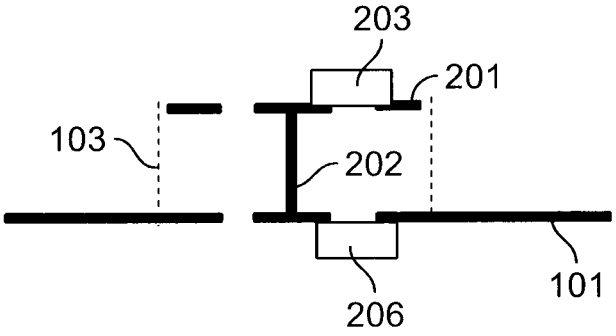
Figure 2F:
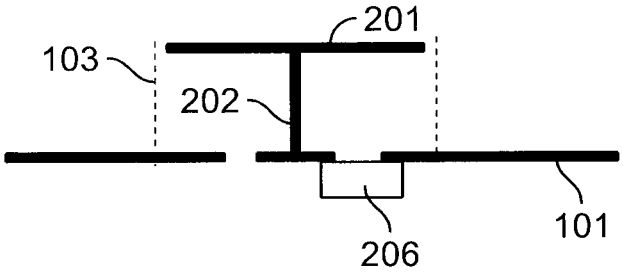
Figure 2G:
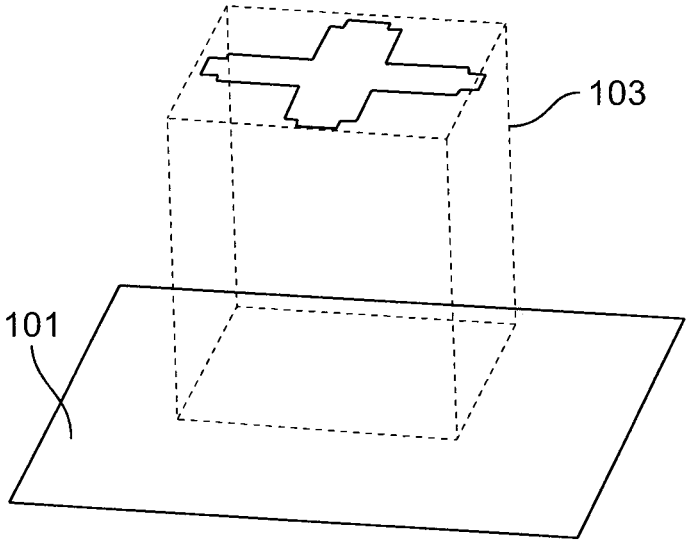

In accordance with the embodiment shown in FIG. 2E, vertical conductor 202 is connected to ground plane 101 via circuit element 206 with the horizontal conductor 201 illustratively shaped similar to that as detailed above and shown in FIG. 2D. In ground plane 101 there is an opening in the center of which there is the bottom end of vertical conductor 202. The bottom end of conductor 202 has no galvanic contact with ground plane 101 and is connected to a first end of circuit element 206. The other second end of circuit element 206 is connected to ground plane 101. In accordance with the embodiment shown in FIG. 2F, circuit element 203 is eliminated and horizontal conductor 201 is galvanic coupled with vertical conductor 202. In accordance with the embodiment shown in FIG. 2G, the connection of vertical conductor with elementary cell 103 is eliminated.

Figure 3:
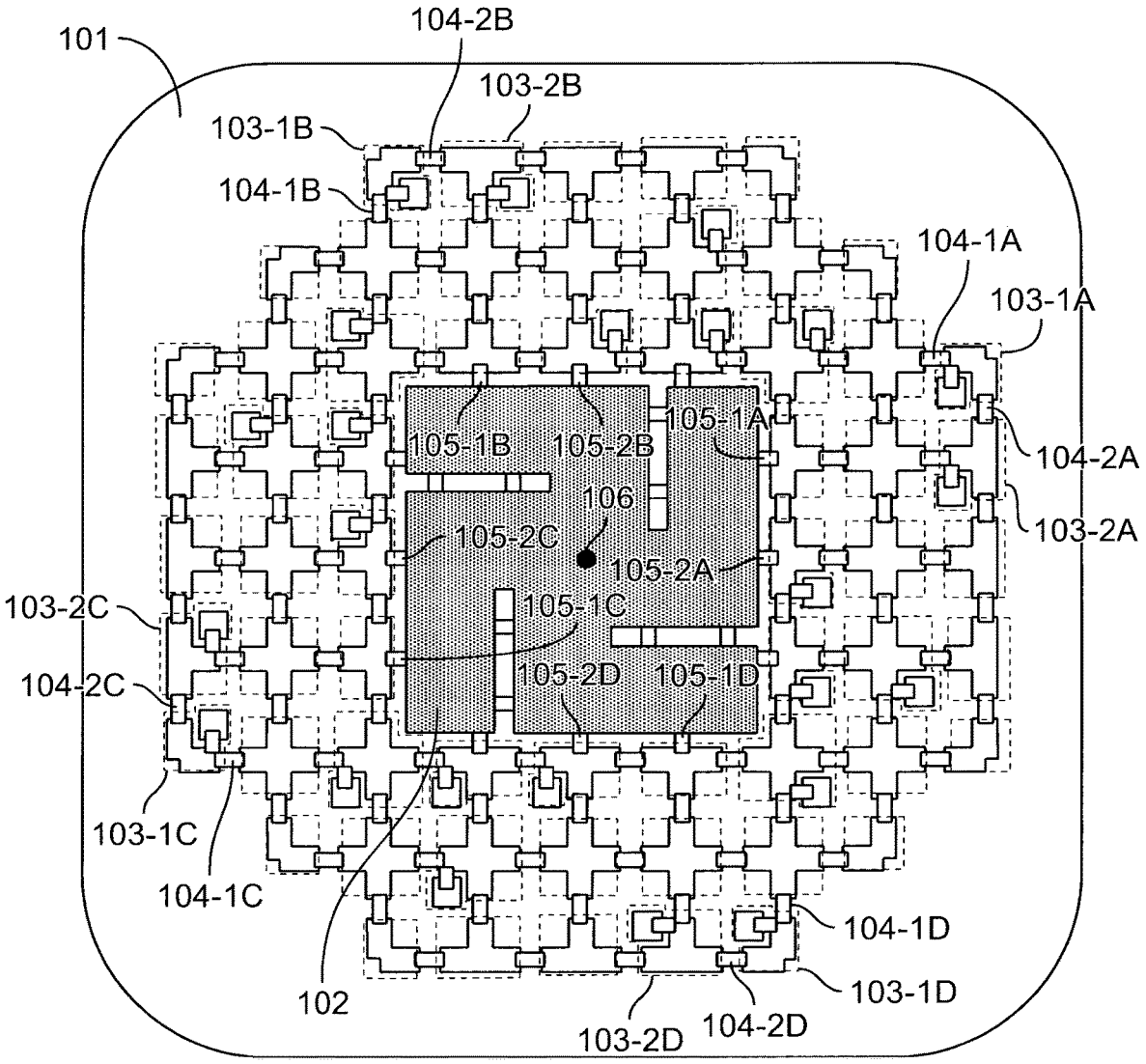
FIG. 3 shows a 4-fold rotation symmetry (i.e., 90° rotational symmetry) of the antenna in FIGS. 1A and 1B in accordance with an embodiment.

As detailed previously, in accordance with an embodiment, antenna 100 may comprise different elementary cells 103 while maintaining 4-fold rotational symmetry (90°) relative to vertical axis 106. To that end, FIG. 3 shows the 4-fold rotation symmetry of antenna 100 (shown in FIG. 1) in accordance with an embodiment. As shown in FIG. 3, elementary cells 103-1A, 103-1B, 103-1C and 103-1D have the same design and are arranged with 4-fold rotational symmetry (90°) relative to vertical axis 106. Elementary cells 103-2A, 103-2B, 103-2C and 103-2D also have the same design and are arranged with 4-fold rotational symmetry (90°) relative to vertical axis 106. However, the design of elementary cell 103-1A is different from that of elementary cell 103-2A. In particular, a horizontal conductor of elementary cell 103-1A is L-shaped, and a horizontal conductor of elementary cell 103-2A is T-shaped. As noted previously, vertical conductor 202 may be present in certain ones of elementary cells 103, and absent in other ones of the elementary cells (e.g., absent from elementary cells 102). The antenna embodiment shown in FIG. 3 comprises different circuit elements 104 while still maintaining 4-fold rotational symmetry (90°).

For example, circuit elements 104-1A, 104-1B, 104-1C and 104-1D have the same impedance and are arranged to achieve 90° symmetry relative to vertical axis 106 in accordance with the embodiment. Circuit elements 104-2A, 104-2B, 104-2C and 104-2D have equal impedance as well and are arranged symmetrically about vertical axis 106. The impedance of circuit element 104-1A can differ from impedance of circuit element 103-4A. In particular, the impedance of circuit element 104-1A can correspond to an idle run condition (i.e., the element is missing), and the impedance of circuit element 104-2A can correspond to a short circuit condition. Similarly, the impedance of circuit elements can be different in circuit elements 105-1A, 105-1B, 105-1C and 105-1D, and 105-2A, 105-2B, 105-2C and 105-2D.

Figure 4:
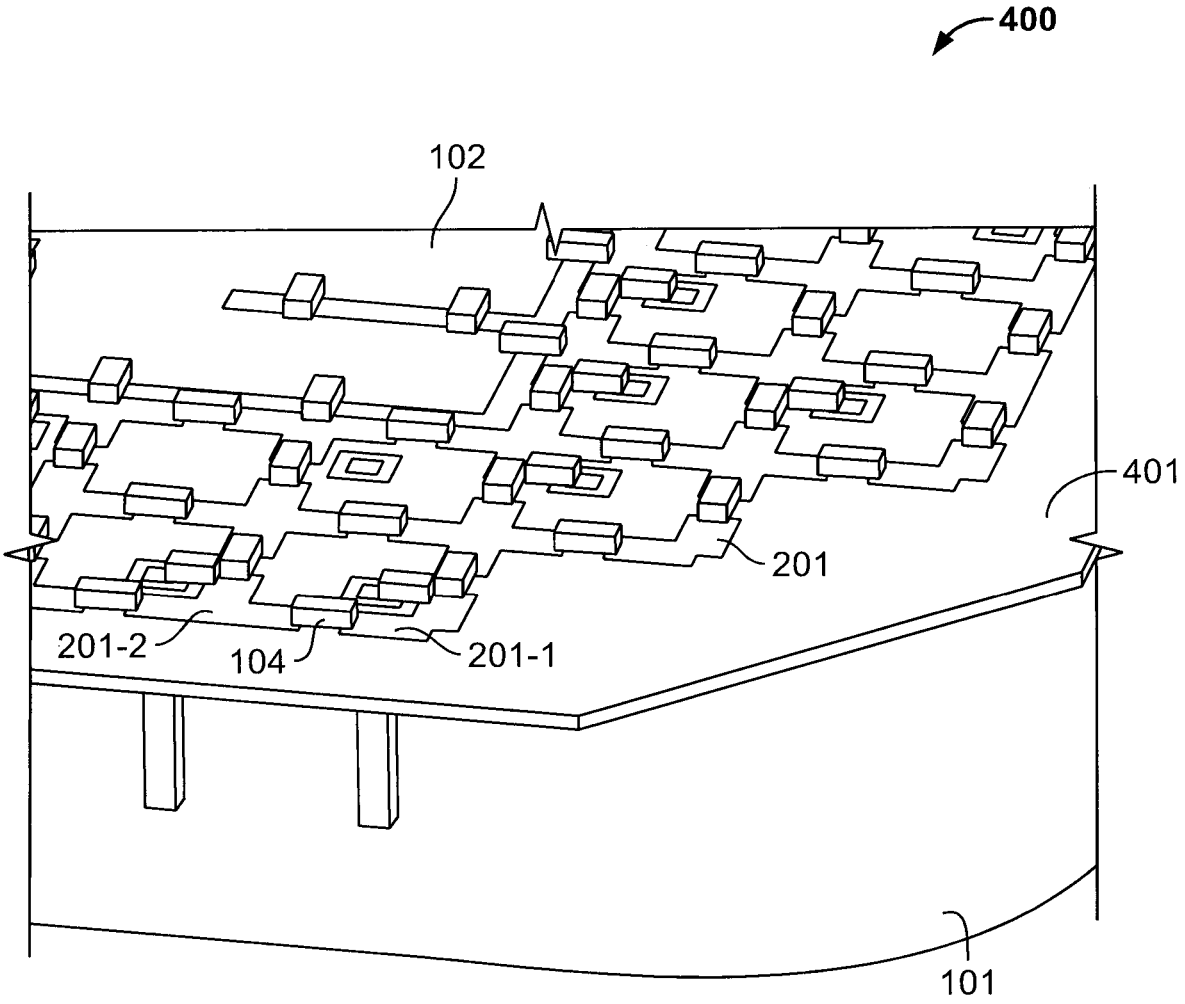
FIG. 4 shows an antenna having lumped circuit elements configured in accordance with an embodiment.
Figure 5A:
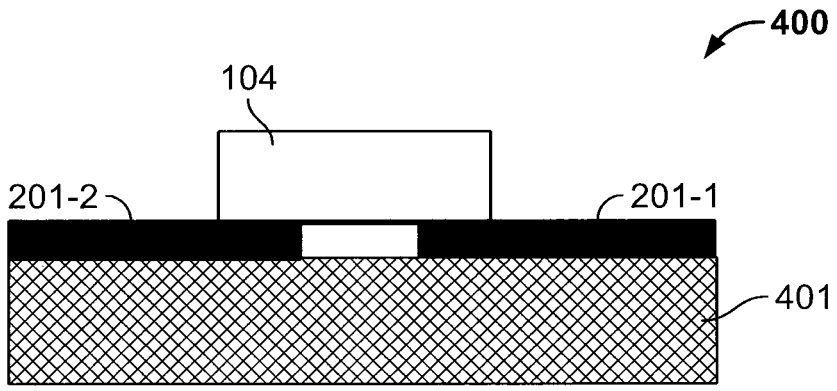
FIGS. 5A-5C show various alternative configurations for the circuit elements shown in FIGS. 1A and 1B.

FIG. 4 shows antenna 400 having lumped circuit elements configured in accordance with an embodiment. As shown, horizontal conductors 201 are illustratively manufactured in the form of a metallization layer in PCB 401. Driven element 102 and the dividing circuit can be also placed on PCB 401. In the embodiment, each circuit element 104 is made as a lumped circuit element soldered to horizontal conductors 201 of elementary cells 103. As shown, horizontal conductors 201-1 and 201-2 belong to neighboring elementary cells 103 (see, FIG. 1B), and circuit element 104 is connected to such neighboring cells and soldered out to PCB 401. In a well-known fashion, circuit element 104 can be made as a lumped capacitor, inductor or resistor. FIG. 5A gives a side view of antenna 400 having the lumped circuit elements configured as detailed above.

Figure 5B:
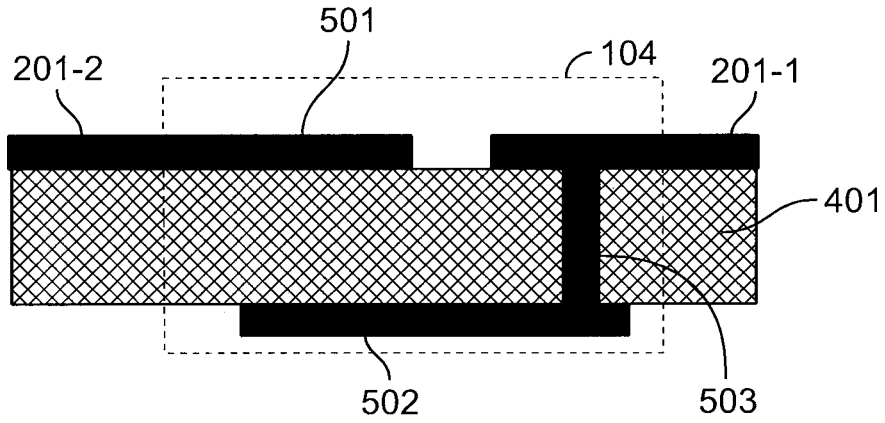
Figure 5C:
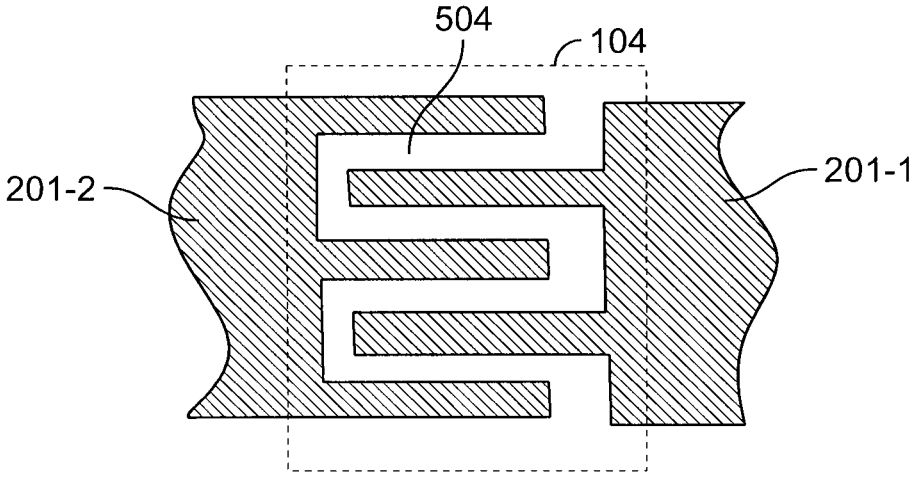

If capacitive impedance is required, circuit element 104 can be made as a distributed element. In this case, circuit element 104 is a plurality of conductors in PCB 401. FIG. 5B shows an embodiment wherein circuit element 104 is in the form of conductor 501 located in a first (e.g., top) layer of PCB 401, and conductor 502 in second (e.g., bottom) layer of PCB 401. Conductor 502 is connected to conductor 201-1 with the aid of metallized hole 503 in a conventional manner. Circuit element 104 can be also made as interdigital structure 504, as shown in FIG. 5C, in which the length of the region between two electrodes is increased by an interlocking-finger design for metallization of the electrodes. Circuit elements 105, 203, and 206 can be made in the same way, and ground plane 101 can be manufactured as a PCB.

Figure 6A:
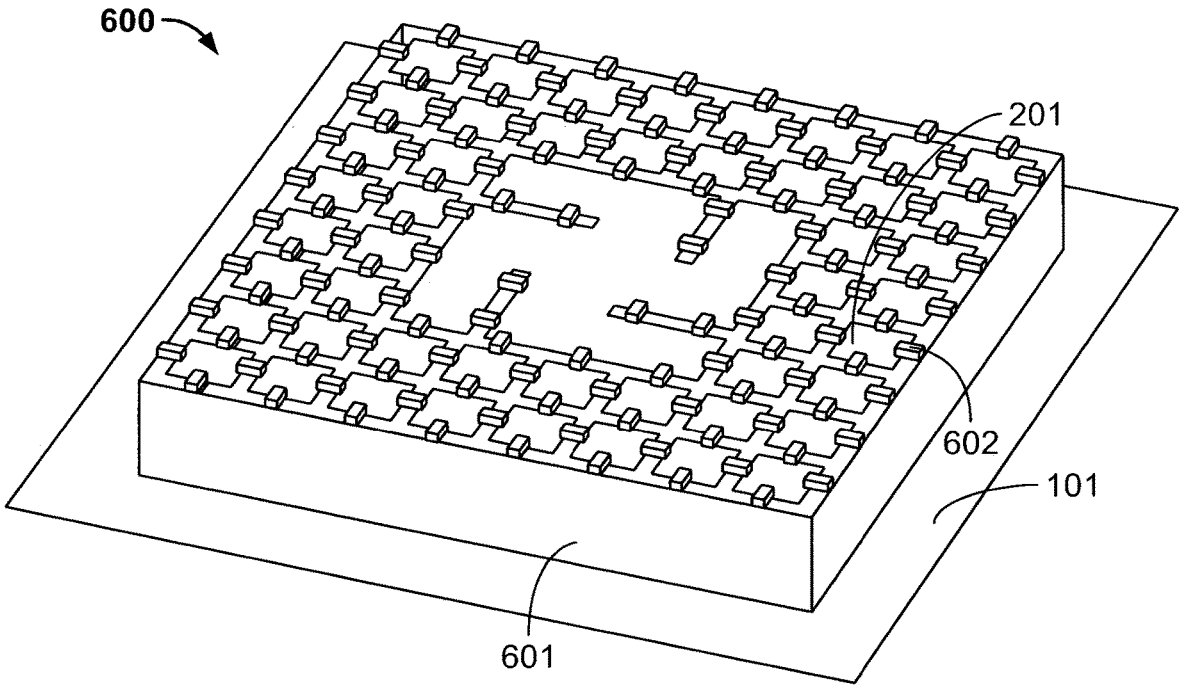
FIGS. 6A and 6B show an exemplary antenna having a vertical wall configuration in accordance with an embodiment.
Figure 6B:
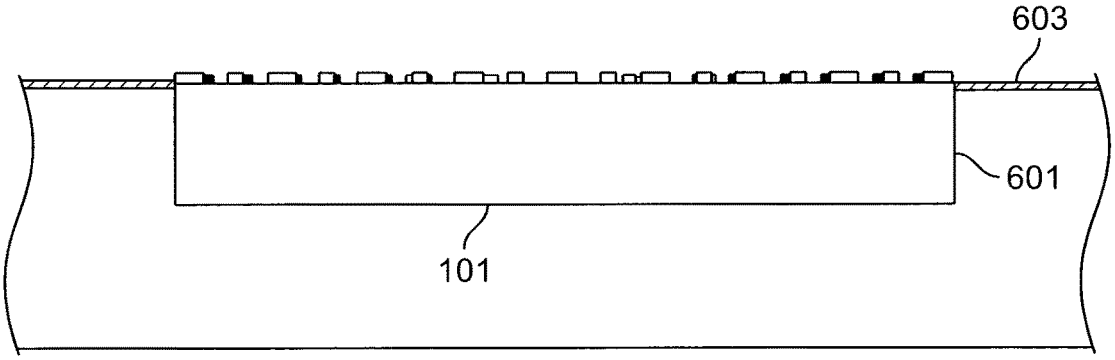

FIGS. 6A and 6B shows antenna 600 configured in accordance with an embodiment using a conducting vertical wall (i.e., a conducting vertical coupling element). In particular, conducting vertical wall 601 is maintained along the entire external perimeter of the antenna. Illustratively, vertical wall 601 comprises four (4) rectangular conductors. In other embodiments, vertical wall 601 can be shaped as a cylinder or a polygon. In this case, there is an additional plurality of circuit elements 602. Each circuit element of the plurality of circuit elements 602 is connected with the a first edge (i.e., top edge) of vertical wall 601 via one end and connected with the corresponding horizontal conductor 201 via the other end. The plurality of circuit elements 602 can comprise elements with different impedance, however 4-fold rotational symmetry is maintained for elements 104, as detailed previously. Also, the second edge (i.e., bottom edge) of vertical wall 601 along the entire perimeter is connected with ground plane 101. In a further embodiment, the top end of vertical wall 601 can be connected with flat metal surface 603, as shown in FIG. 6B. Illustratively, surface 603 can be an integrated part of the housing to where the antenna is fixed, for example, an aircraft body. In this case, the antenna is flush with the body rather than protruding therefrom in order to achieve better aerodynamic characteristics of the aircraft.

Figure 7A:
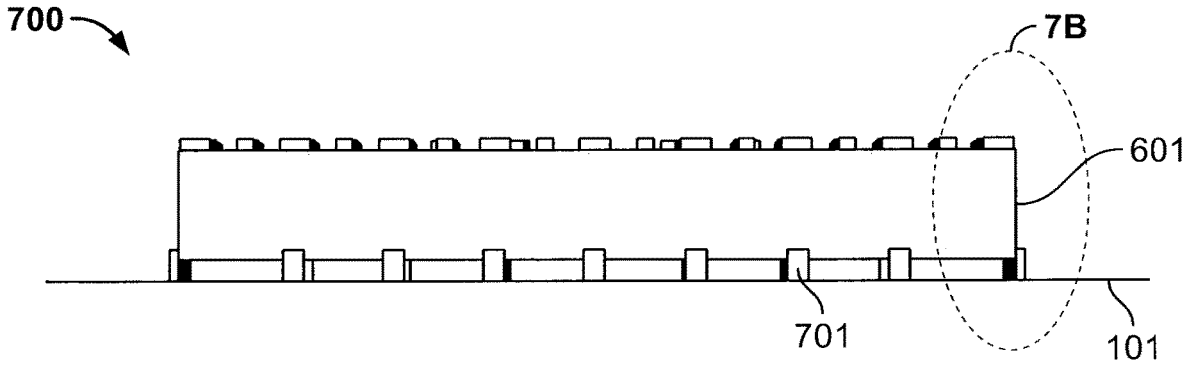
FIGS. 7A and 7B show an exemplary antenna using a connection of a vertical wall to a ground plane via circuit elements in accordance with an embodiment.
Figure 7B:
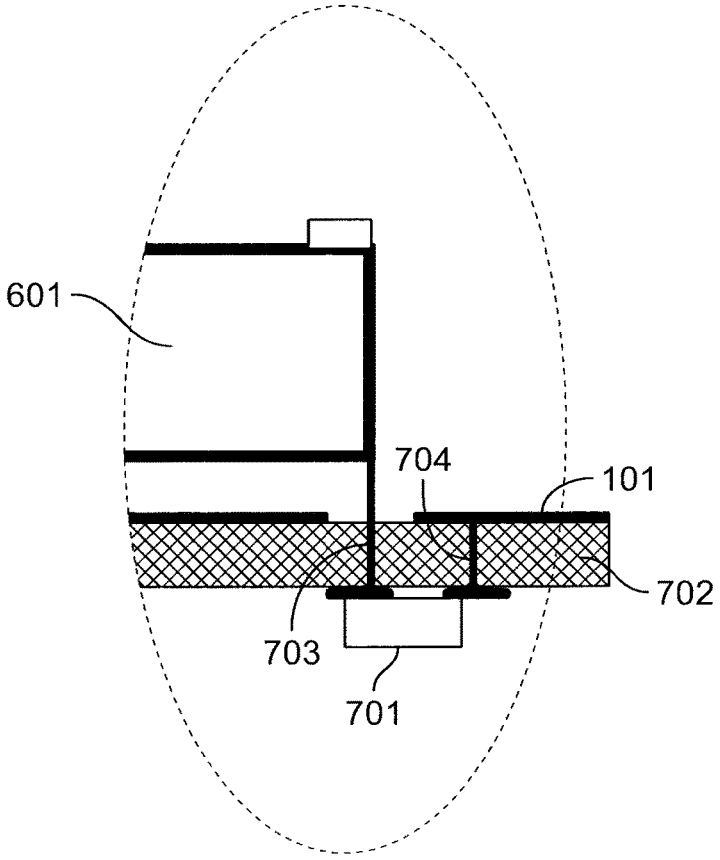

FIGS. 7A and 7B show exemplary antenna 700 using a connection of a vertical wall (i.e., a conducting vertical coupling element) to a ground plane via circuit elements in accordance with an embodiment. Here, as shown in FIG. 7A, vertical wall 601 has no galvanic contact with ground plane 101, and the slot being between vertical wall 601 and ground plane 101. In this slot there can be a plurality of circuit elements 701, one end of each of such circuit elements is connected to vertical wall 601, and the other end is connected with ground plane 101. In practice, such a structure can be implemented by manufacturing ground plane 101 in the form of a metallization layer in PCB 702, as shown in FIG. 7B. Each circuit element of the plurality of circuit elements 701 is located on the bottom side of PCB 701. One end of circuit element 701 is connected with vertical wall 601 using vertical pin 703, and the other end of circuit element 701 is connected with ground plane 101 using metallized hole 704 in a conventional manner. The plurality of circuit elements 701 comprise elements with different impedance and maintaining the 4-fold rotational symmetry, as detailed above for elements 104. Availability of the slot between vertical wall 601 and ground plane 101 excites an additional electromagnetic field thereby reducing DP back-lobe level after subtraction from the field of driven element 102.

The nominal impedance values of the individual circuit elements in pluralities of circuit elements 104, 105, 203 and 206, respectively, are selected by an optimization procedure. More particularly, since the impedance of circuit elements in the pluralities of circuit elements 104, 105, 203 and 206 is the only variable parameter, and the geometric parameters do not change in optimization, the electrodynamic problem can be reduced to calculating a scattering matrix and partial DP, which considerably decreases computation time and allows for a consideration of structures with sufficient complexity and with a greater number of optimized parameters. The use of the optimization procedure with a preliminary calculation of scattering matrix is described, for example, in "Fast Optimization of Ultra-Broadband Antennas With Distributed Matching Networks", D. Bianchi et al., IEEE Antennas and Wireless Propagation Letters, Vol. 13, 2014, which is hereby incorporated by reference.

In view of dividing the whole structure into elementary cells having only horizontal and vertical conductors, as detailed above, the calculation of the scattering matrix is considerably simplified as well. The synthesis of antenna 100, for example, will now be discussed. At a first iteration all elementary cells 103 are the same with an extremely sophisticated design, i.e., in addition to horizontal conductor 201 there is vertical conductor 202 and circuit element 203, as shown, for example, in FIG. 2A. Circuit elements 104 are connected to all possible ends of each elementary cell 103. Further, the electrodynamic problem is solved and the impedance of circuit elements are determined according to the obtained scattering matrix with the assistance of the optimizer in a conventional manner. After that, if any circuit element 203 in operation of the optimizer needs idle run impedance, the corresponding circuit element 203 and possibly vertical conductor 202 are removed from the structure. Thus, elementary cells shown in FIG. 2D are obtained from elementary cells shown in FIG. 2A. Similarly, circuit elements 104 and 105 are removed from the structure, if they require impedance close to idle run in the process of optimization. The circuit elements, impedance of which are near to a short circuit condition, are replaced by metal conductors. During optimization, a structure with a smaller number of optimized parameters but with more diverse elementary cells 103 is achieved. Further, the scattering matrix is calculated anew, and the optimization procedure must be executed again.

Figure 8A:
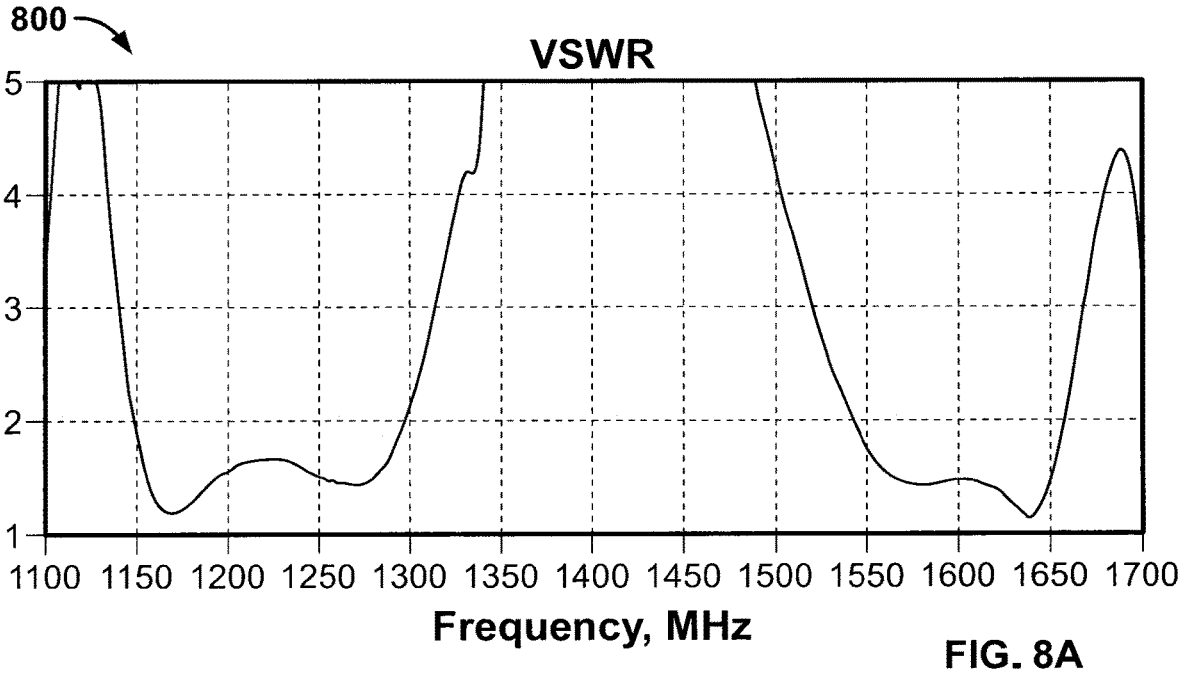
FIGS. 8A and 8B show plots of experimental results produced using the antenna embodiment shown in FIGS. 1A, 1B and 4.
Figure 8B:
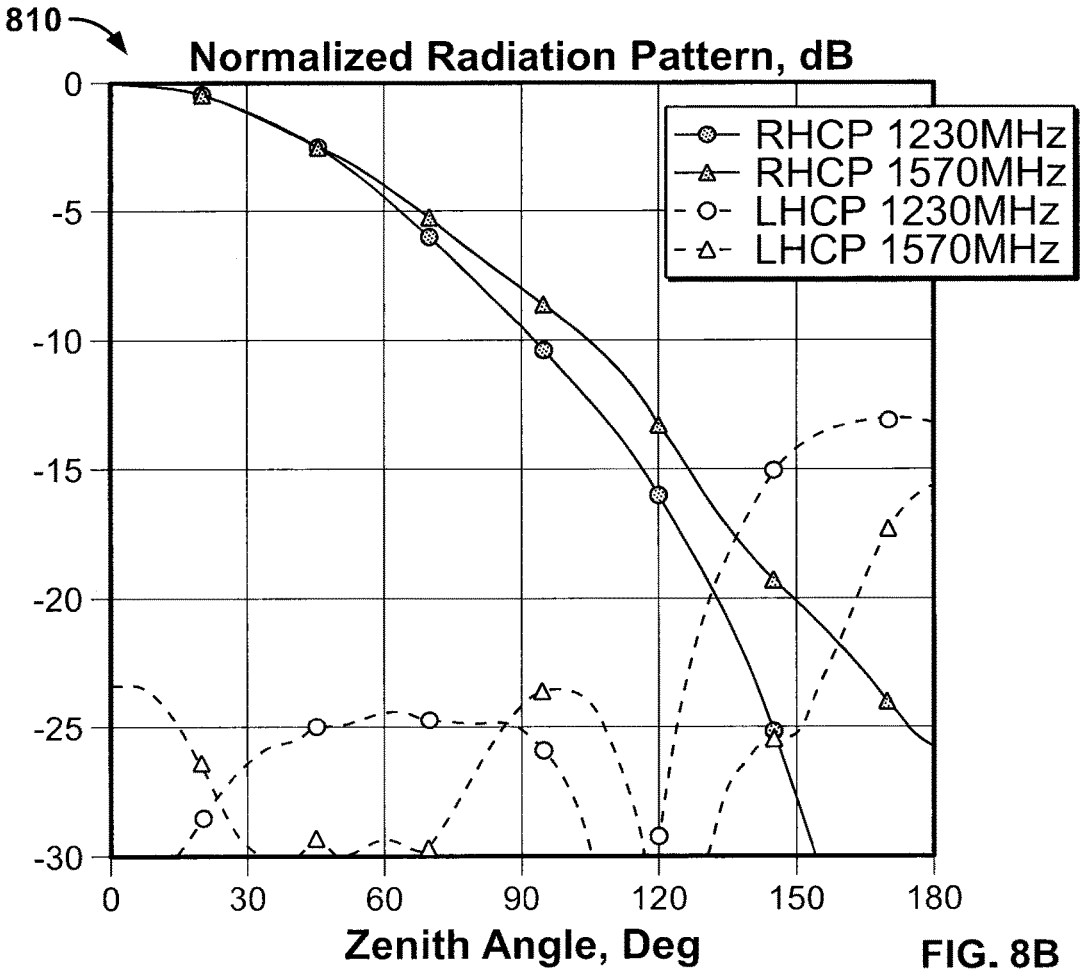

FIGS. 8A and 8B show plots 800 and 810, respectively, of experimental results produced using the antenna embodiment shown in FIGS. 1A, 1B and 4, respectively. The specific antenna structure utilized to generate these results comprised sixty (60) elementary cells according to the configurations shown in FIGS. 2A-C and FIG. 2G, one hundred (100) circuit elements 104, and twelve (12) circuit elements 105. The antenna structure maintains 4-fold rotational symmetry with the nominal values of fifteen (15) circuit elements 203, twenty-five (25) circuit elements 104 and three (3) circuit elements 105 were determined using the optimization procedure, as detailed above. The height of PCB 401 over ground plane 101 was 12 millimeters, and ground plane 101 is a receiver housing with horizontal dimensions of 110 millimeters×110 millimeters, and a height of 60 millimeters. Based on the results shown in FIG. 8A and FIG. 8B, the antenna obtained in optimization had a VSWR level no greater than two (2) in the entire GNSS band (i.e., 1165-1300 MHz and 1540-1610 MHz), and the back-lobe level of no more than −12 dB with all circuit elements 104, 105 and 203 having capacitive impedance.

Figure 9:
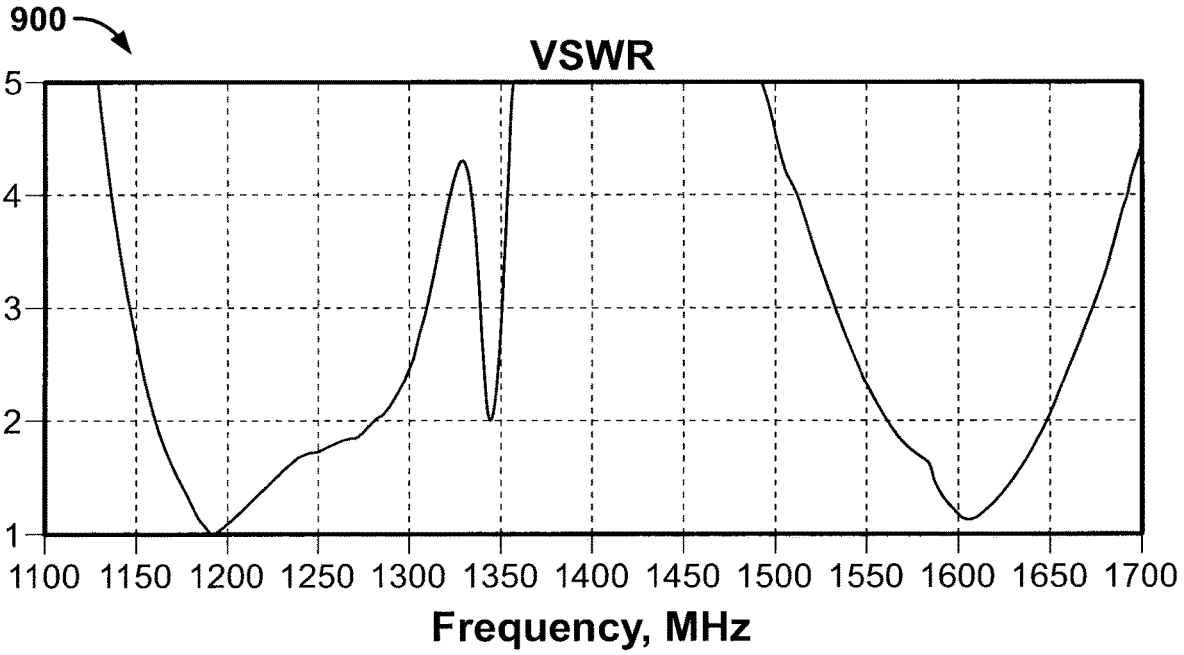
FIG. 9 shows a plot of Voltage Standing Wave Ratio (VSWR) results produced using the antenna embodiment shown in FIGS. 1A and 1B.

FIG. 9 shows plot 900 of VSWR results produced using the antenna embodiment shown in FIG. 6. In this case, the antenna structure had four vertical walls 601 15 millimeters high×80 millimeters long, and 30 independent parameters were optimized. As can be seen from plot 900, VSWR results do not exceed level two (2) in practically all GNSS bands.

Figure 10:
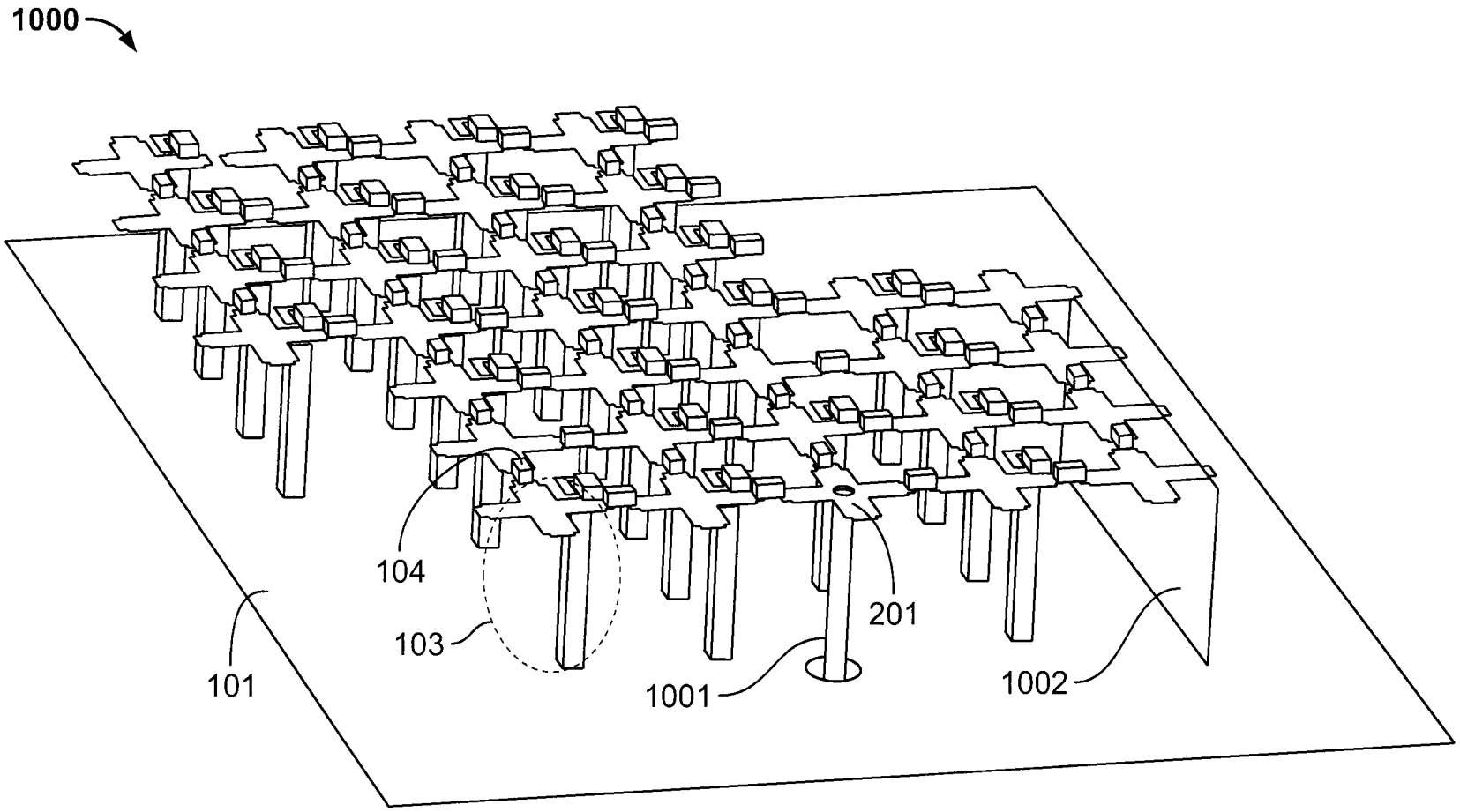
FIG. 10 shows an antenna in accordance with an embodiment lacking 4-fold rotation symmetry.

FIG. 10 shows an antenna in accordance with an embodiment lacking four-fold rotation symmetry. In this embodiment, the antenna comprises ground plane 101, a plurality of elementary cells 103, a plurality of circuit elements 104, and driven pin 1001. It will be noted this antenna structure can be operated in both circularly-polarized electromagnetic radiation and linearly-polarized electromagnetic radiation modes. As shown, one end of driven pin 1001 is connected to the horizontal conductor 201 of any one of the elementary cells in the plurality of elementary cells 103. The other end of driven pin 1001 passes through the hole of ground plane 101 and is connected to the center conductor of the supplying coaxial cable. The structure has vertical conducting wall 1002, the bottom edge of which is connected to ground plane 101 and the top edge is connected with the horizontal conductors of the plurality of elementary cells 103.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

What is claimed is:

1. An antenna comprising:

a ground plane;

a driven element exciting a right hand circularly polarized wave;

a plurality of elementary cells arranged around the driven element wherein at least one elementary cell of the plurality of elementary cells is different from each of the remaining elementary cells in the plurality of elementary cells, and each elementary cell of the plurality of elementary cells comprises a first conductor located above and parallel with the ground plane; and a first plurality of circuit elements, each circuit element of the first plurality of circuit elements connecting a particular pair of elementary cells in the plurality of elementary cells such that the antenna maintains a 4-fold rotational symmetry relative to a vertical axis.

2. The antenna of claim 1 further comprising:

a second plurality of circuit elements, each circuit element of the second plurality of circuit elements connecting a particular one of the elementary cells in the plurality of elementary cells with the driven element.

3. The antenna of claim 1 wherein at least one of the elementary cells of the plurality of elementary cells further comprises:

a second conductor connected and orthogonal to the ground plane; and an individual circuit element connecting the first conductor with the second conductor.

4. The antenna of claim 1 wherein the antenna further comprises:

a conducting vertical coupling element located along a peripheral region of the antenna and having a first edge and a second edge, the first edge being above the second edge, and multiple ones of the elementary cells of the plurality of elementary cells are connected to the first edge of the conducting vertical coupling element by multiple ones of a third plurality of circuit elements.

5. The antenna of claim 4 wherein the second edge of the conducting vertical coupling element is galvanic coupled with the ground plane.

6. The antenna of claim 5 further comprising:

a housing having a metal surface wherein the first edge of the conducting vertical coupling element is connected with the metal surface of the housing.

7. The antenna of claim 6 wherein at least one of the elementary cells of the plurality of elementary cells further comprises:

a second conductor connected and orthogonal to the ground plane; and an individual circuit element connecting the first conductor associated with the at least one of the elementary cells with the second conductor.

8. The antenna of claim 4 wherein between the second edge of the conducting vertical coupling element and the ground plane there is a slot having a fourth plurality of circuit elements configured therein, each circuit element of the fourth plurality of circuit elements having a respective first end and a respective second end such that the respective first end of the circuit elements is connected with the conducting vertical coupling element and the respective second end is connected with the ground plane.

9. The antenna of claim 8 further comprising:

a pin for connecting at least one of the circuit elements in the fourth plurality of circuit elements with the conducting vertical coupling element.

10. The antenna of claim 9 further comprising:

a through-hole traversing the ground plane and for connecting at least one of the circuit elements in the fourth plurality of circuit elements with the ground plane.

11. The antenna of claim 1 wherein the first plurality of circuit elements includes at least one circuit element selected from the group consisting of a lumped capacitor, lumped inductor and lumped resistor.

12. The antenna of claim 1 wherein the first conductor is connected to a plurality of contact pads.

13. The antenna of claim 1 wherein the first conductor is formed as one of a cross-shape, a T-shape and an L-shape.

14. The antenna of claim 1 further comprising:

a plurality for slots formed in the driven element for use in the exciting the right hand circularly polarized wave.

15. An antenna comprising:

a ground plane with a through-hole;

a driven pin having a first end and a second end;

a plurality of elementary cells wherein at least one elementary cell of the plurality of elementary cells is different from each of the remaining elementary cells in the plurality of elementary cells, each elementary cell of the plurality of elementary cells comprising a first conductor located above and parallel with the ground plane, and the first end of the driven pin being connected to the first conductor associated with a particular one of the elementary cells; and a plurality of circuit elements, each circuit element of the plurality of circuit elements connecting a particular pair of elementary cells in the plurality of elementary cells.

16. The antenna of claim 15 wherein at least one of the elementary cells of the plurality of elementary cells further comprises:

a second conductor connected and orthogonal to the ground plane; and an individual circuit element connecting the first conductor associated with the at least one of the elementary cells with the second conductor.

17. The antenna of claim 15 further comprising:

a conducting vertical wall having a first edge and a second edge, the first edge being above the second edge, the first edge being connected to the first conductor associated with at least one of the elementary cells and the second edge being connected to the ground plane.

18. The antenna of claim 15 further comprising:

a through-hole traversing the ground plane such that the driven pin passes through the through-hole for connecting the second end of the driven pin with a coaxial cable external to the ground plane.

19. The antenna of claim 15 wherein the antenna is operable for both circularly-polarized electromagnetic radiation and linearly-polarized electromagnetic radiation modes.

20. The antenna of claim 15 wherein the antenna lacks 4-fold rotational symmetry.

* * * * *